US006046111A

United States Patent [19]

Robinson

[11] Patent Number: 6,046,111

[45] Date of Patent: Apr. 4, 2000

[54] METHOD AND APPARATUS FOR ENDPOINTING MECHANICAL AND CHEMICAL-MECHANICAL PLANARIZATION OF MICROELECTRONIC SUBSTRATES

[75] Inventor: Karl M. Robinson, Boise, Id.

[73] Assignee: Micron Technology, Inc., Boise, Id.

[21] Appl. No.: 09/146,330

[22] Filed: Sep. 2, 1998

[51] Int. Cl.[7] ..... H01L 21/00

[52] U.S. Cl. ..... 438/693; 156/345; 216/38; 216/85; 252/79.1; 438/745; 438/8

[58] Field of Search ..... 438/8, 14, 16, 438/690, 691, 692, 693, 745, 747; 216/38, 52, 59, 60, 84, 85, 91; 156/345 L, 345 LC, 345 P; 252/79.1, 79.5; 106/3

[56] References Cited

U.S. PATENT DOCUMENTS

| | | | |
|---|---|---|---|
| 4,200,395 | 4/1980 | Smith et al. | 356/356 |
| 4,203,799 | 5/1980 | Sugawara et al. | 156/601 |
| 4,358,338 | 11/1982 | Downey et al. | 156/627 |
| 4,367,044 | 1/1983 | Booth, Jr. et al. | 356/357 |
| 4,377,028 | 3/1983 | Imahashi | 29/574 |
| 4,422,764 | 12/1983 | Eastman | 356/357 |
| 4,640,002 | 2/1987 | Phillips et al. | 29/574 |
| 4,660,980 | 4/1987 | Takabayashi et al. | 356/357 |
| 4,717,255 | 1/1988 | Ulbers | 356/345 |
| 4,879,258 | 11/1989 | Fisher | 437/225 |
| 5,036,015 | 7/1991 | Sandhu et al. | 437/8 |
| 5,064,683 | 11/1991 | Poon et al. | 427/39 |
| 5,069,002 | 12/1991 | Sandhu et al. | 51/165 |
| 5,081,796 | 1/1992 | Schultz | 51/165.74 |
| 5,154,021 | 10/1992 | Bombardier et al. | 51/262 |
| 5,216,843 | 6/1993 | Breivogel et al. | 51/131.1 |
| 5,220,405 | 6/1993 | Barbee et al. | 356/357 |
| 5,314,843 | 5/1994 | Yu et al. | 437/225 |
| 5,324,381 | 6/1994 | Nishiguchi | 156/297 |
| 5,369,488 | 11/1994 | Morokuma | 356/358 |
| 5,413,941 | 5/1995 | Koos et al. | 437/8 |
| 5,433,651 | 7/1995 | Lustig et al. | 451/6 |
| 5,461,007 | 10/1995 | Kobayashi | 437/225 |
| 5,465,154 | 11/1995 | Levy | 356/382 |
| 5,597,442 | 1/1997 | Chen et al. | 156/626.1 |
| 5,609,719 | 3/1997 | Hempel | 156/636.1 |
| 5,616,069 | 4/1997 | Walker et al. | 451/56 |
| 5,643,050 | 7/1997 | Chen | 451/10 |
| 5,663,797 | 9/1997 | Sandhu | 438/16 |
| 5,733,176 | 3/1998 | Robinson et al. | 451/41 |
| 5,762,537 | 6/1998 | Sandhu et al. | 451/7 |
| 5,777,739 | 7/1998 | Sandhu et al. | 356/357 |

OTHER PUBLICATIONS

"End Point Detector for Chemi–Mechanical Polisher," IBM Technical Disclosure Bulletin, vol. 31, No. 4, Sep. 1998.

"Model 6DQ Servo Controlled Polisher," R. Howard Strasbaugh, Inc., Huntington Beach, CA, p. 8, Apr. 1987.

*Primary Examiner*—William Powell

*Attorney, Agent, or Firm*—Dorsey & Whitney LLP

[57] ABSTRACT

A method and apparatus for endpointing mechanical and chemical-mechanical planarization of semiconductor wafers, field emission displays and other microelectronic substrates. In one application in which a microelectronic substrate is planarized against a planarizing medium defined by a planarizing fluid and a polishing pad, one method of endpointing the planarizing process in accordance with the invention includes increasing the viscosity of the planarizing fluid between the substrate and the polishing pad as the substrate becomes substantially planar. The endpointing method continues by detecting a change in drag or frictional force between the substrate and the planarizing medium, and then stopping removal of material from the substrate when the rate that the friction increases between the substrate and the planarizing medium changes from a first rate to a second rate greater than the first rate. To increase the viscosity of the planarizing fluid as the substrate becomes planar, the method may further include adding resistance elements to the planarizing fluid. The resistance elements are typically separate from the abrasive particles in the planarizing medium, and the resistance elements can be selected to cause the viscosity of the planarizing fluid to increase from a first viscosity when the substrate is not substantially planar to a second viscosity when the substrate becomes at least substantially planar.

71 Claims, 4 Drawing Sheets

METHOD AND APPARATUS FOR ENDPOINTING MECHANICAL AND CHEMICAL-MECHANICAL PLANARIZATION OF MICROELECTRONIC SUBSTRATES

TECHNICAL FIELD

The present invention relates to devices and methods for measuring the endpoint of a microelectronic substrate in mechanical and chemical-mechanical planarizing processes.

BACKGROUND OF THE INVENTION

Mechanical and chemical-mechanical planarizing processes (collectively "CMP") are used in the manufacturing of microelectronic devices for forming a flat surface on semiconductor wafers, field emission displays and many other microelectronic substrates. FIG. 1 schematically illustrates a planarizing machine 10 with a platen or table 20, a carrier assembly 30, a polishing pad 40, and a planarizing fluid 44 on the polishing pad 40. The planarizing machine 10 may also have an under-pad 25 attached to an upper surface 22 of the platen 20 for supporting the polishing pad 40. In many planarizing machines, a drive assembly 26 rotates (arrow A) and/or reciprocates (arrow B) the platen 20 to move the polishing pad 40 during planarization.

The carrier assembly 30 controls and protects a substrate 12 during planarization. The carrier assembly 30 typically has a substrate holder 32 with a pad 34 that holds the substrate 12 via suction. A drive assembly 36 of the carrier assembly 30 typically rotates and/or translates the substrate holder 32 (arrows C and D, respectively). The substrate holder 32, however, may be a weighted, free-floating disk (not shown) that slides over the polishing pad 40.

The combination of the polishing pad 40 and the planarizing fluid 44 generally define a planarizing medium that mechanically and/or chemically-mechanically removes material from the surface of the substrate 12. The polishing pad 40 may be a conventional polishing pad composed of a polymeric material (e.g., polyurethane) without abrasive particles, or it may be an abrasive polishing pad with abrasive particles fixedly bonded to a suspension material. In a typical application, the planarizing fluid 44 may be a CMP slurry with abrasive particles and chemicals for use with a conventional nonabrasive polishing pad. In other applications, the planarizing fluid 44 may be a chemical solution without abrasive particles for use with an abrasive polishing pad.

To planarize the substrate 12 with the planarizing machine 10, the carrier assembly 30 presses the substrate 12 against a planarizing surface 42 of the polishing pad 40 in the presence of the planarizing fluid 44. The platen 20 and/or the substrate holder 32 then move relative to one another to translate the substrate 12 across the planarizing surface 42. As a result, the abrasive particles and/or the chemicals in the planarizing medium remove material from the surface of the substrate 12.

CMP processes must consistently and accurately produce a uniformly planar surface on the substrate to enable precise fabrication of circuits and photo-patterns. Prior to being planarized, many substrates have large "step heights" that create a highly topographic surface across the substrate. Yet, as the density of integrated circuits increases, it is necessary to have a planar substrate surface at several stages of processing the substrate because non-uniform substrate surfaces significantly increase the difficulty of forming sub-micron features or photo-patterns to within a tolerance of approximately 0.1 $\mu$m. Thus, CMP processes must typically transform a highly topographical substrate surface into a highly uniform, planar substrate surface (e.g., a "blanket surface").

In the competitive semiconductor industry, it is highly desirable to maximize the throughput of CMP processing by producing a blanket surface on a substrate as quickly as possible. The throughput of CMP processing is a function of several factors, one of which is the ability to accurately stop CMP processing at a desired endpoint. In a typical CMP process, the desired endpoint is reached when the surface of the substrate is a blanket surface and/or when enough material has been removed from the substrate to form discrete components on the substrate (e.g., shallow trench isolation areas, contacts, damascene lines, etc.). Accurately stopping CMP processing at a desired endpoint is important for maintaining a high throughput because the substrate may need to be re-polished if the substrate is "under-planarized." Accurately stopping CMP processing at the desired endpoint is also important because too much material can be removed from the substrate, and thus the substrate may be "over-polished." For example, over-polishing can cause "dishing" in shallow-trench isolation structures, or over-polishing can complete destroy a section of the substrate. Thus, it is highly desirable to stop CMP processing at the desired endpoint.

In one conventional method for determining the endpoint of CMP processing, the planarizing period of one substrate in a run is estimated using the polishing rate of previous substrates in the run. The estimated planarizing period for a particular substrate, however, may not be accurate because the polishing rate may change from one substrate to another. Thus, this method may not accurately planarize all of the substrates in a run to the desired endpoint.

In another method for determining the endpoint of CMP processing, the substrate is removed from the pad and the substrate carrier, and then a measuring device measures a change in thickness of the substrate. Removing the substrate from the pad and substrate carrier, however, is time-consuming and may damage the substrate. Thus, this method generally reduces the throughput of CMP processing.

In still another method for determining the endpoint of CMP processing, a portion of the substrate is moved beyond the edge of the pad, and an interferometer directs a beam of light directly onto the exposed portion of the substrate. The substrate, however, may not be in the same reference position each time it overhangs the pad. For example, because the edge of the pad is compressible, the substrate may not be at the same elevation for each measurement. Thus, this method may inaccurately measure the change in thickness of the wafer.

In yet another method for determining the endpoint of CMP processing, U.S. Pat. No. 5,036,015, which is herein incorporated by reference, discloses detecting the planar endpoint by sensing a chance in friction between a wafer and the polishing medium. Such a change of friction may be produced by a different coefficient of friction at the wafer surface as one material (e.g., an oxide) is removed from the wafer to expose another material (e.g., a nitride). In addition to the different coefficients of friction caused by a change of material at the substrate surface, the friction between the wafer and the planarizing medium generally increases during CMP processing because more surface area of the substrate contacts the polishing pad as the substrate becomes more planar. U.S. Pat. No. 5,036,075 discloses detecting the change in friction by measuring the change in current through the platen drive motor and/or the drive motor for the substrate holder.

Although the endpoint detection technique disclosed in U.S. Pat. No. 5,036,015 is an improvement over the previous endpointing methods, the increase in current through the motors may not accurately indicate the endpoint of a substrate. For example, the friction between the substrate and the planarizing medium generally increases substantially linearly, and thus the rate that the motor current increases at the end point may not be different enough from the rest of the CMP cycle to provide a definite signal identifying that the endpoint has been reached. In one application in which a substrate was planarized in a Rodel ILD-1300 slurry, the current through the platen motor increased from approximately 19 to 20 amps from the beginning to the endpoint of the CMP process. Moreover, the rate that the platen motor current increased was substantially constant making it difficult to determine when the substrate surface became at least substantially planar. Therefore, CMP processing may be stopped at an inaccurate elevation within the substrate using the apparatus and method disclosed in U.S. Pat. No. 5,036,015.

SUMMARY OF THE INVENTION

The present invention is generally directed toward endpointing mechanical and chemical-mechanical planarization of semiconductor wafers, field emission displays and other microelectronic substrates. In one application in which a microelectronic substrate is planarized with a planarizing medium defined by a planarizing fluid and a polishing pad, the viscosity of the planarizing fluid between the substrate and the polishing pad increases as the substrate becomes substantially planar. The viscosity of the planarizing fluid preferably increases from a first viscosity when the substrate is not substantially planar to a second viscosity when the substrate becomes at least substantially planar. Additionally, the change in viscosity of the planarizing fluid is preferably a function of the planarity of the substrate surface. Accordingly, by increasing the viscosity of the planarizing fluid between the substrate and the polishing pad as the substrate becomes planar, the drag or frictional force between the substrate and the planarizing medium increases more rapidly as the substrate becomes substantially planar compared to when the substrate is not substantially planar. The endpointing continues by detecting a change in drag force between the substrate and the planarizing medium, and then stopping removal of material from the substrate when the drag between the substrate and the planarizing medium increases corresponding to the change in viscosity of the planarizing fluid. Thus, when the drag increases significantly more rapidly relative to an earlier stage of the CMP cycle, it provides a clear indication that the substrate is at least substantially planar.

To increase the viscosity of the planarizing fluid as the substrate becomes planar, resistance elements may be added to the planarizing fluid. The resistance elements are typically separate from any abrasive particles in the planarizing medium, and the resistance elements preferably cause a rapid, non-linear increase in viscosity of the planarizing fluid between the substrate and the polishing pad as the substrate becomes planar. The resistance elements may cause the drag force between the substrate and the planarizing medium to increase at a first rate when the substrate is not substantially planar and at a second rate when the substrate is at least substantially planar. The second rate that the drag force increases is greater than the first rate. The resistance elements preferably cause the drag force between the substrate and the planarizing medium to increase exponentially during planarization to provide an accurate and reliable signal that the substrate surface is at least substantially planar.

In one application of the invention, a planarizing fluid includes a liquid solution and resistance elements composed of spherical latex particles. The resistance elements typically have particle sizes of 2–100 nm so that then form a colloidal planarizing fluid, and more preferably the resistance elements have particle sizes of 5–10 nm. The resistance elements are generally 2.5% to 10% by weight of the planarizing fluid. The planarizing fluid can also include a plurality of abrasive particles composed of aluminum oxide, silicon oxide, cerium oxide and/or tantalum oxide. The particle size of the abrasive particles is typically 12–300 nm, and generally about 100 nm.

DETAILED DESCRIPTION OF THE INVENTION

The present invention is directed toward devices and methods for mechanical and/or chemical-mechanical planarization of substrates used in the manufacturing of microelectronic devices. Many specific details of certain embodiments of the invention are set forth in the following description and in FIGS. 2–6 to provide a thorough understanding of such embodiments. One skilled in the art, however, will understand that the present invention may have additional embodiments, or that the invention may be practiced without several of the details described in the following description.

Figure 1:
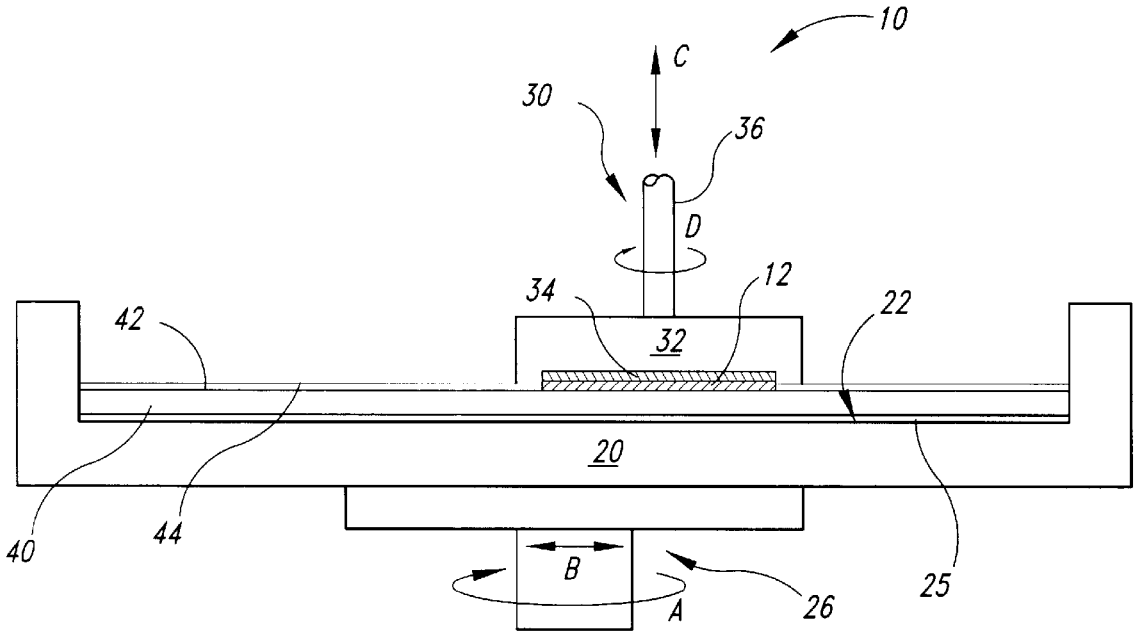
Fig. 1 (Prior Art)
FIG. 1 is a schematic elevational view of a planarizing machine in accordance with the prior art.
Figure 2:
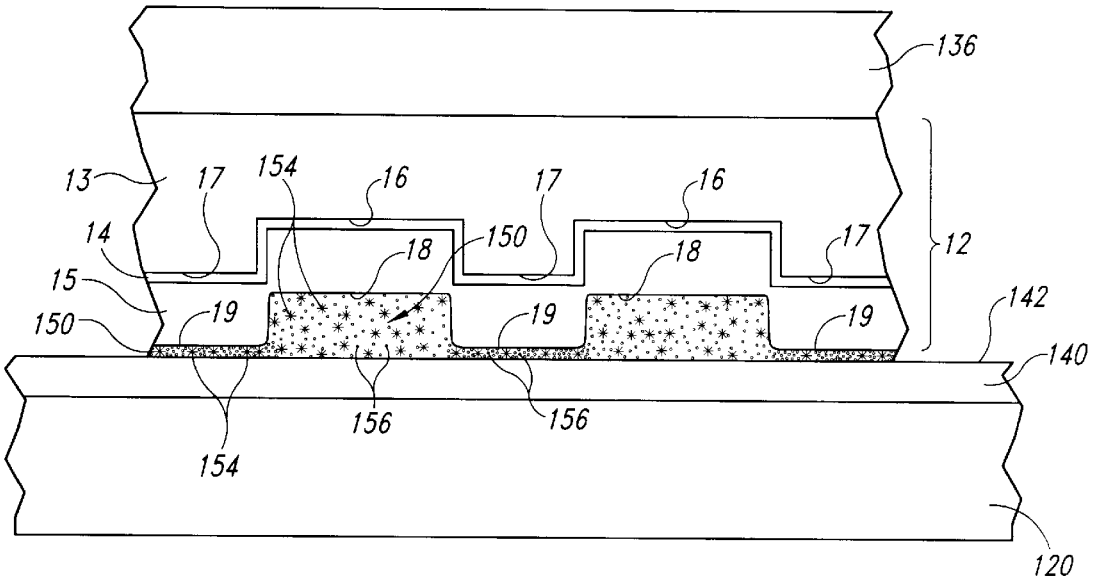
FIG. 2 is a schematic cross-sectional view of a planarizing fluid in accordance with one embodiment of the invention at one stage of planarizing a microelectronic substrate.

FIG. 2 is a partial schematic cross-sectional view of a substrate 12 being planarized on a polishing pad 140 in the presence of a planarizing fluid 150 in accordance with one embodiment of the invention. The polishing pad 140 and the planarizing fluid 150 together define a planarizing medium. In this example, a number of shallow trench isolation structures are to be formed on the substrate 12. The substrate 12 accordingly has a substrate layer 13, a polish-stop layer 14, and an oxide layer 15 covering the polish-stop layer 14. A number of trenches 16 are initially etched into the substrate layer 13 such that the substrate layer 13 also has a number of faces 17. Because the polish-stop layer 14 and the oxide layer 15 are conformal layers, the oxide layer 15 has a number of depressions 18 aligned with the trenches 16 and a number of tips 19 aligned with the faces 17 of the substrate layer 13. Although many aspects of the planarizing fluid 150 are described with respect to the substrate 12, the planarizing fluid 150 may be used to planarize many other types of microelectronic substrates. Thus, FIG. 2 illustrates one stage in the operation of the planarizing fluid 150 on only one type of substrate.

In this embodiment, the planarizing fluid 150 includes a liquid solution 152, a plurality of abrasive particles 154, and a plurality of viscosity altering elements separate from the abrasive particles 154. The viscosity altering elements can be resistance elements 156, or they can be thinning elements. The resistance elements 156 can be spherical, smooth and generally incompressible particles that stay in solution with the liquid 152 without affecting the stability of the planarizing fluid 150. The resistance elements 156, for example, are typically non-abrasive colloidal elements that do not alter the abrasiveness of the planarizing fluid 150. As set forth in more detail below, the resistance elements 156 preferably increase the viscosity of the planarizing fluid 150 between the substrate 12 and the polishing pad 140 as the substrate becomes at least substantially planar. The thinning elements, such as star polymers, generally decrease the viscosity of the planarizing fluid 150 as the substrate becomes at least substantially planar.

The planarizing fluid 150 may have several different embodiments. For example, the abrasive particles 154 typically have particle sizes greater than 50 nm, but other particle sizes of 12–500 nm may also be used. The abrasive particles 154 may be composed of aluminum oxides, silicon oxides, cerium oxides, tantalum oxides, manganese oxides and/or other known abrasive particles. The resistive elements 156 typically have colloidal particle sizes of 2–100 nm, and more preferably of 5–10 nm. The resistance elements 156 may be composed of abrasive or non-abrasive particles. In one embodiment, the resistance elements 156 are non-abrasive latex spheres having particle sizes of 2–100 nm, more preferably from 5–50 nm, and most preferably from 5–10 nm. In addition to the non-abrasive latex spheres, other suitable resistance elements 156 include small silica particles and polyvinyl alcohol beads.

To make the planarizing fluid 150, a desired quantity of resistance elements 156 can be admixed with a commercially existing CMP planarizing fluid. The planarizing fluid 150 generally has 2%–20% by weight resistance elements 156, 2%–30% by weight abrasive particles 154, and 50%–90% by weight liquid solution 152. The following are examples of specific embodiments of the planarizing fluid 150:

EXAMPLE 1

Approximately 30% by weight colloidal silica abrasive particles (12–50 nm). Approximately 65% by weight ammonia or potassium based liquid solution. Approximately 5% by weight spherical latex resistance elements (5–10 nm). A premixed slurry with colloidal silica abrasive particles and ammonia or potassium based liquid solutions is available without the resistance elements from Rodel Corporation, Newark, Del. (e.g., Klevesol PL 1508).

EXAMPLE 2

Approximately 13% by weight fumed silica particles (100–200 nm). Approximately 82% by weight ammonia based liquid solution. Approximately 5% by weight spherical latex elements (5–10 nm). A premixed slurry with the fumed silica particles and the ammonia based liquid solution is available without the resistance elements from Rodel Corporation (e.g. ILD-1300).

Still referring to FIG. 2, a substrate holder 136 presses the substrate 12 against the polishing pad 140, and at least one of the substrate holder 136 or a platen 120 moves relative to the other to impart relative motion between the substrate 12 and the polishing pad 140. As the substrate 12 engages the polishing pad 140, a number of abrasive particles 154 and resistance elements 156 are trapped between the tips 19 on the substrate 12 and the polishing pad 140. The abrasive particles 154 accordingly remove material from the tips 19 of the substrate 12, and the resistance elements 156 rub against each other, the polishing pad 140, and the substrate 12 to increase the drag force against the substrate 12. The remainder of the abrasive particles 154 and the resistance elements 156 under the substrate 12 are entrapped in the depressions 18. The abrasive particles 154 in the depressions 18, however, do not remove material from the oxide layer 15 in the depressions 18. As such, the tips 19 of the oxide layer 15 planarize much faster than the portion of the oxide layer in the depressions 18 to change the substrate 12 from a highly topographic substrate to one having a blanket surface or highly planar surface.

Figure 3:
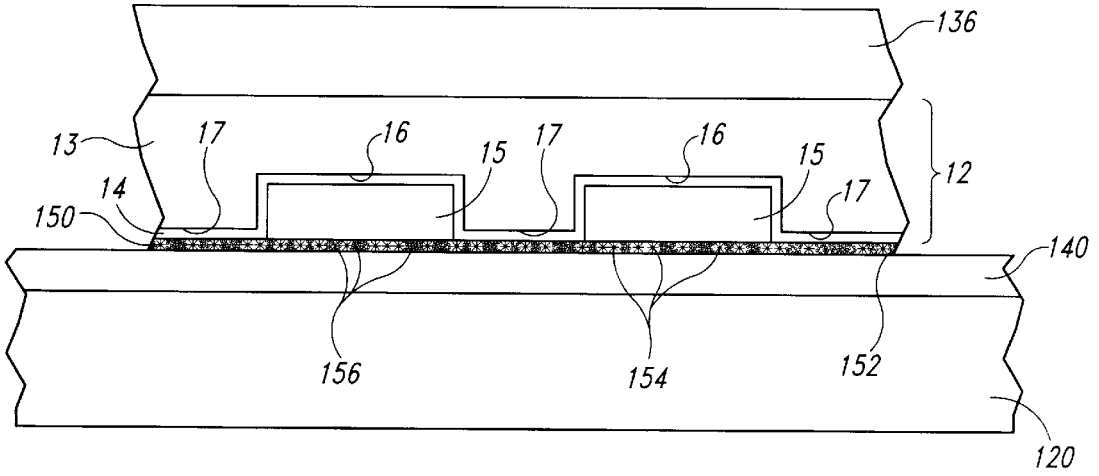
FIG. 3 is a schematic cross-sectional view of the planarizing fluid of FIG. 2 at another stage of planarizing the microelectronic substrate.

FIG. 3 is a partial cross-sectional view of the substrate 12 and the planarizing fluid 150 illustrating a subsequent stage in the operation of the planarizing fluid 150. The substrate 12 has been planarized to a point at which a portion of the oxide layer 15 has been removed to expose the sections of the polish-stop layer 14 over the faces 17 of the substrate layer 13. The remaining portions of the oxide layer 15 in the trenches 16 of the substrate layer 13 define shallow trench isolation structures on the substrate 12. Because the substrate 12 is at least substantially planar, more surface area on the substrate 12 presses the abrasive particles 154 and the resistance elements 156 against the polishing pad 140. Additionally, because the resistance elements 156 are very small, substantially incompressible particles, many resistance elements 156 engage each other between the substrate 12 and the polishing pad 140. The increasing contact between the resistance elements 156 as the substrate 12 becomes planar generates increasing electrostatic forces between the resistance elements 156, and thus the resistance elements 156 become attracted to each other. The local viscosity of the planarizing fluid 150 between the substrate 12 and the polishing pad 140 accordingly increases as the substrate 12 becomes planar. Thus, as the substrate 12 becomes more planar, the planarizing fluid 150 with resistance elements 156 causes the drag force between the substrate 12 and the planarizing medium to increase non-linearly at a much faster rate for a planar substrate than a non-planar substrate.

Figure 4:
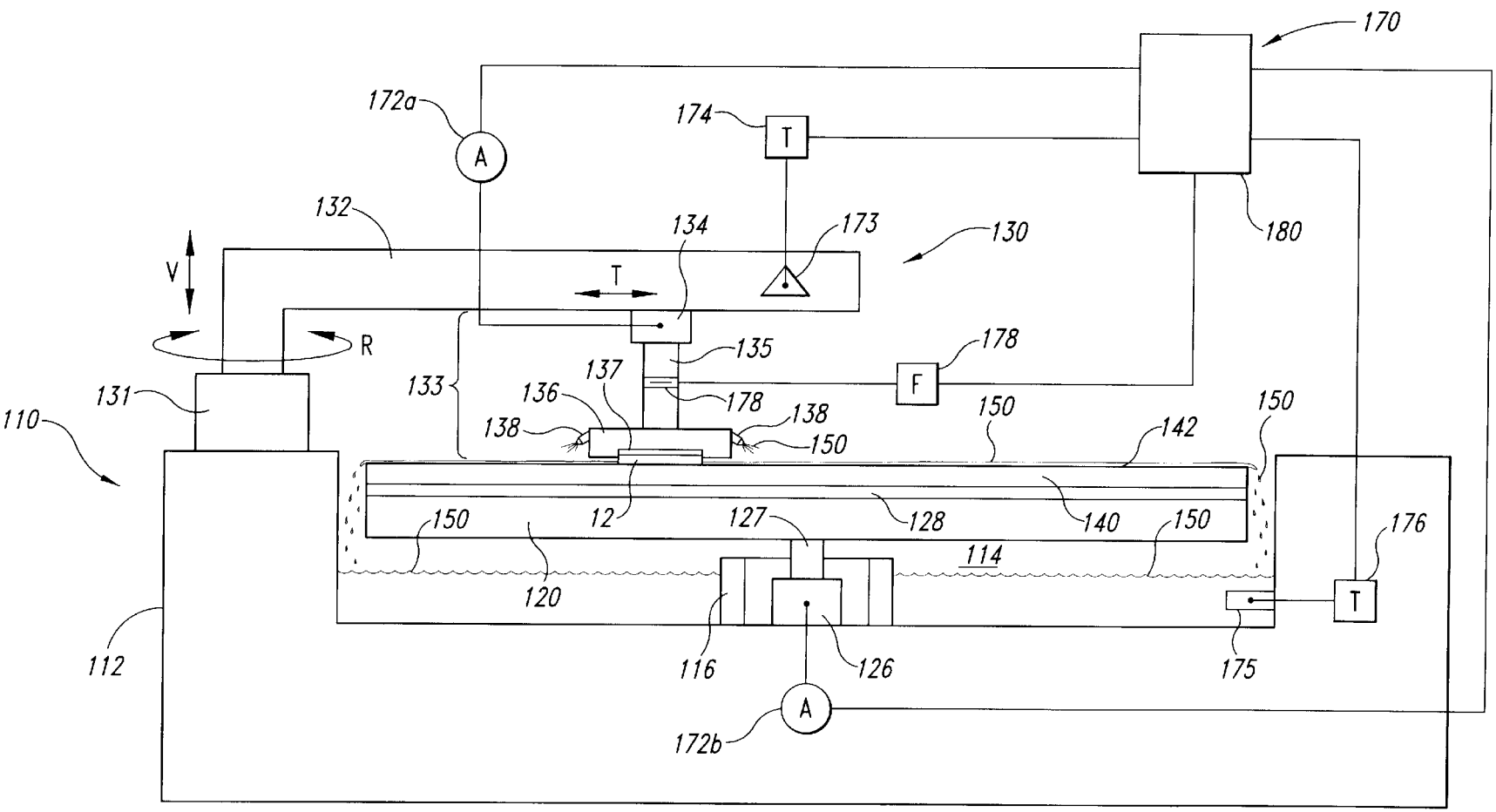
FIG. 4 is a schematic cross-sectional view of a planarizing machine in accordance with an embodiment of the invention.

FIG. 4 is a schematic cross-sectional view of a planarizing machine 110 with the planarizing fluid 150 in accordance with one embodiment of the invention for planarizing the substrate 12. The planarizing machine 110 may include a housing 112, a reservoir 114 in the housing 112, and a shield 116 in the reservoir 114. The planarizing machine 110 also has a platen or table 120 attached to a drive motor 126 via a shaft 127. The shaft 127 carries the platen 120 in the upper portion of the reservoir 114. The platen 120 typically carries an under pad 128, and the under pad 128 typically carries the polishing pad 140. Accordingly, the platen drive motor 126 rotates the shaft 127 to rotate the platen 120 and the polishing pad 140.

The planarizing machine 110 also has a carrier assembly 130 to move the substrate 12 with respect to the polishing pad 140. In one embodiment, the carrier assembly 130 has a primary actuator 131, an arm 132 attached to the primary actuator 131, and a substrate holder assembly 133 attached to the arm 132. In operation, the primary actuator 131 rotates the arm 132 (arrow R) and/or moves the arm 132 vertically (arrow V). The substrate holder assembly 133 can also have a secondary drive motor 134 movably attached to the arm 132, and the substrate holder 136 is coupled to the secondary drive motor 134 via a shaft 135. In one embodiment, the secondary motor 134 rotates the substrate holder 136 to rotate the substrate 12, and the secondary motor 134 translates along the arm 132 (arrow T) to translate the substrate 12 across the polishing pad 140. A back pad 137 is typically attached to the substrate holder 136 to provide a surface to engage the backside of the substrate 12, and a number of nozzles 138 on the substrate holder 136 are generally coupled to a holding tank of planarizing fluid 150. The nozzles 138 accordingly deposit the planarizing fluid 150 onto a planarizing surface 142 of the polishing pad 140.

In addition to the components for moving the substrate 12 and the polishing pad 140, the planarizing machine 110 also has a drag force or friction sensing system 170 for sensing a change in drag force between the substrate 12 and the planarizing medium. The friction sensing system 170 may have several different embodiments. In one embodiment, a current meter 172*a* is coupled to the secondary drive motor 134 of the substrate holder assembly 133 to indicate the current passing through the secondary drive motor 134. In another embodiment, a current meter 172*b* is coupled to the platen drive motor 126 to measure the current passing through the platen drive motor 126. The current through either the secondary drive motor 134 or the platen drive motor 126 changes in proportion to the drag force between the substrate 12 and the planarizing medium. Accordingly, the current meters 172*a* and/or 172*b* are preferably coupled to a controller 180 that monitors the current meters 172*a* and 172*b* and stops the planarizing process when a sufficient change in drag occurs between the substrate 12 and the planarizing medium.

The friction sensing system 170 may also have other types of sensors instead of, or in addition to, the current meters 172*a* and 172*b*. For example, a change in drag force between the substrate 12 and the planarizing medium can be detected by measuring a change in temperature of the planarizing fluid 150. In one embodiment, the change in temperature of the planarizing fluid 150 on the polishing pad 140 can be detected by an infrared sensor 173 attached to the arm 132. The infrared sensor 173 is typically coupled to an analog to digital converter 174 to convert the infrared signals to digital data that may be sent to the controller 180. Suitable A/D converters are well known and can be purchased from commercial suppliers. The change in temperature of the planarizing fluid 150 can also be sensed by a temperature probe 175 in the reservoir 114. The temperature probe 175 may also be coupled to the controller 180 via an A/D converter 176. In either case, the infrared sensor 173 or the temperature probe 175 can sense a change in temperature of the planarizing fluid 150, which corresponds to a change in drag force between the substrate 12 and the polishing pad 140.

In still another embodiment of the friction sensing system 170, a load cell 178 in the shaft 135 of the substrate holder assembly 133 can be coupled to the controller 180 via a converter 178. The load cell 178 typically senses an increase in down force with increasing drag between the substrate 12 and the planarizing medium because more down force is necessary to prevent the substrate 12 from hydroplaning on the planarizing fluid 150 as the substrate 12 becomes more planar. Accordingly, a change in down force applied to the substrate 12 may also indicate a change in drag force between the substrate 12 and the planarizing medium. In light of the components of the planarizing machine 110 that remove material from the substrate 12 and sense the drag force between the substrate 12 and the planarizing medium, a method of endpointing the planarization of the substrate 12 with the planarizing fluid 150 will now be described.

Figure 5:
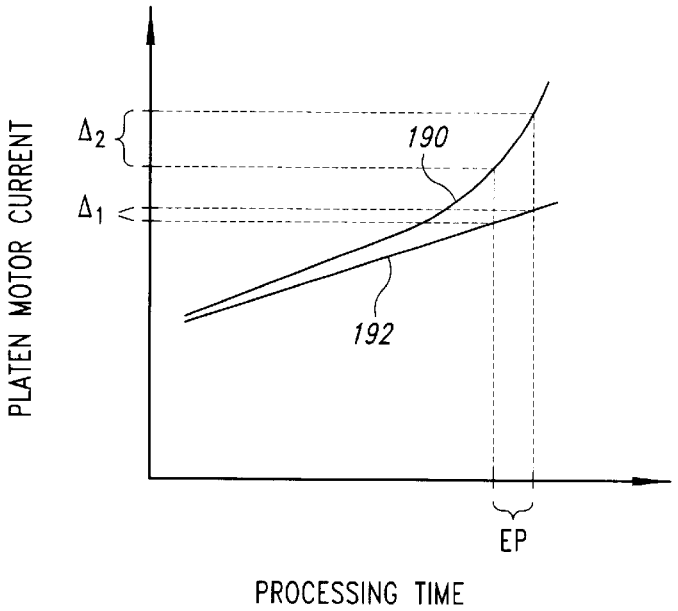
FIG. 5 is a diagram illustrating detecting the endpoint of planarizing a microelectronic substrate in accordance with an embodiment of the invention.

FIG. 5 is a chart comparing an example of the current draw through the platen motor 126 (FIG. 4) for planarizing the substrate 12. A first line 190 represents an example of the current draw for planarizing a substrate 12 with the planarizing fluid 150 having resistance elements 156 (FIGS. 2 and 3). A second line 192 represents an example of the current draw for planarizing the substrate 12 with a conventional planarizing fluid without resistance elements. When the substrate 12 is planarized with a conventional planarizing fluid without resistance elements, the platen motor current increases substantially linearly throughout the processing cycle. As a result, the platen motor current may change by only $\Delta_1$ in a desired endpoint range "EP." When the substrate 12 is planarized with an embodiment of the planarizing fluid 150, however, the platen motor current increases much more rapidly in the endpoint range EP than earlier in the planarizing cycle. As such, the resistance elements 156 cause a significant change $\Delta_2$ in the platen motor current throughout the endpoint range EP. The significant increase in the platen motor current with the planarizing fluid 150 is believed to be a function of the increase in viscosity of the planarizing fluid 150 caused by the resistance elements 156. Thus, because the change in platen motor current $\Delta_2$ for the planarizing fluid 150 is significantly greater in the endpoint range EP than the change $\Delta_1$ for conventional slurries, several embodiments of the planarizing fluid 150 provide a relatively definite signal that the substrate 12 is at a planar endpoint.

In one particular application, in which the planarizing fluid 150 contained 5% by weight resistance elements 156 composed of spherical latex particles having particle sizes of 5–10 nm, the platen motor current increased non-linearly from approximately 20 amps at the beginning of CMP processing to about 34 amps at the endpoint. As set forth above, the platen motor current for a conventional Rodel ILD 1300 slurry without resistance elements increased from 19 amps to only approximately 20 amps throughout the planarizing process. Therefore, compared to conventional planarizing fluids without resistance elements, a planarizing fluid with spherical latex resistance elements produces a more accurate, reliable indication of the endpoint of CMP processing.

Figure 6:
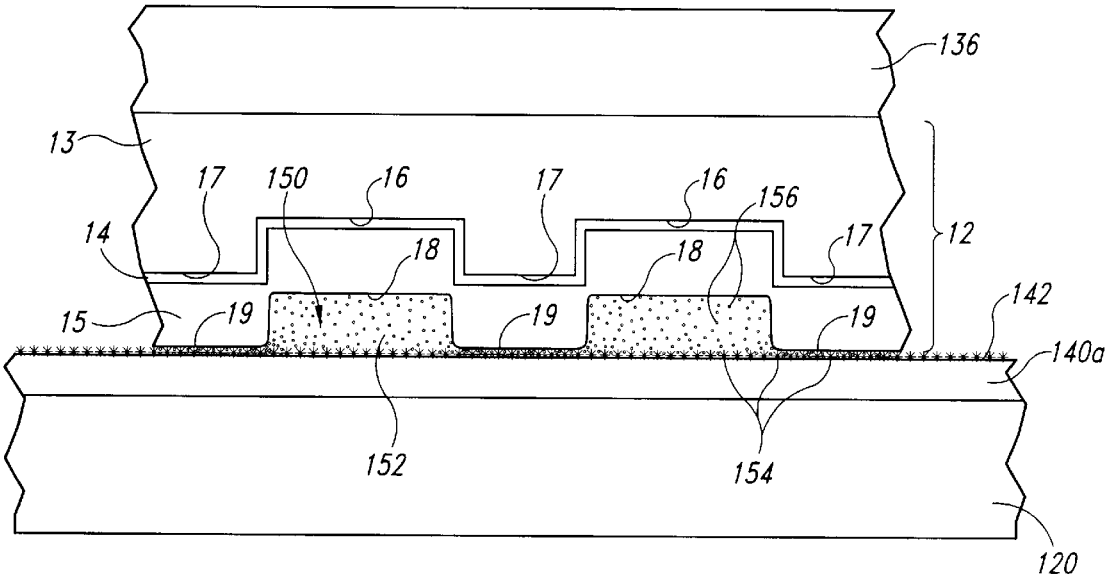
FIG. 6 is a schematic cross-sectional view of another planarizing fluid in accordance with another embodiment of the invention for planarizing a microelectronic substrate.

FIG. 6 is a partial cross-sectional view of the substrate 12 being planarized against a fixed-abrasive polishing pad 140*a* in the presence of the planarizing fluid 150. In this embodiment, the abrasive particles 154 are embedded or otherwise fixedly attached to the planarizing surface 142 of the polishing pad 140*a*. One suitable fixed abrasive pad 140*a* is disclosed in U.S. Pat. No. 5,624,303, which is herein incorporated by reference. In operation, the resistance elements 156 in the planarizing fluid 150 increase the drag force between the substrate 12 and the planarizing medium defined by the planarizing fluid 150, the abrasive particles 154 in the fixed-abrasive pad 140*a*, and the pad 140*a* itself. Accordingly, the planarizing fluid 150 can operate with both non-abrasive and abrasive polishing pads by increasing the viscosity of the planarizing fluid as a function of the planarity of the substrate.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. In a planarizing process of a microelectronic substrate against a planarizing medium defined by a planarizing fluid and a polishing pad, a method of endpointing the planarizing process, comprising:

changing the viscosity of the planarizing fluid between the substrate and the polishing pad as the substrate becomes at least substantially planar;

detecting a change in drag force between the substrate and the planarizing medium; and stopping removal of material from the substrate when a change in drag force between the substrate and the planarizing medium increases from a first rate at one stage of the process to a second greater rate at a subsequent stage of the process corresponding to an increase in viscosity of the planarizing fluid.

2. The method of claim 1 wherein changing the viscosity of the planarizing fluid comprises adding resistance elements to the planarizing fluid, the resistance elements being separate from a plurality of abrasive particles in the planarizing medium, and the resistance elements causing a rapid increase in viscosity of the planarizing fluid as the substrate becomes substantially planar.

3. The method of claim 1 wherein:

detecting a change in drag force between the substrate and the planarizing medium comprises measuring a change in amperage through a drive motor that moves a table supporting the polishing pad; and stopping removal of material from the substrate comprises ceasing the planarizing process when the amperage rapidly changes.

4. The method of claim 1 wherein:

detecting a change in drag force between the substrate and the planarizing medium comprises measuring a change in amperage through a secondary motor that moves a substrate holder carrying the substrate; and stopping removal of material from the substrate comprises ceasing the planarizing process when the amperage rapidly changes.

5. The method of claim 1 wherein the viscosity of the planarizing fluid increases as the substrate becomes substantially planar, and wherein detecting a change in drag force between the substrate and the planarizing medium comprises measuring an increase in amperage through a drive motor that moves a table supporting the polishing pad.

6. The method of claim 1 wherein the viscosity of the planarizing fluid decreases as the substrate becomes substantially planar, and wherein detecting a change in drag force between the substrate and the planarizing medium comprises measuring a decrease in amperage through a drive motor that moves a table supporting the polishing pad.

7. The method of claim 1 wherein:

detecting a change in drag force between the substrate and the planarizing medium comprises measuring a temperature of a component of the planarizing process; and stopping removal of material from the substrate comprises ceasing the planarizing process when the temperature of the component rapidly changes.

8. The method of claim 7 wherein measuring a change in temperature of a component comprises sensing the temperature of the planarizing fluid flowing off of the polishing pad with a temperature probe.

9. The method of claim 7 wherein measuring a change in temperature of a component comprises sensing the temperature of the planarizing fluid on the polishing pad with an infrared sensor.

10. The method of claim 1 wherein:

the planarizing fluid comprises a liquid solution, a plurality of spherical resistance elements composed of latex, and a plurality of abrasive particles; and the method further comprises depositing the planarizing solution onto the polishing pad.

11. The method of claim 1 wherein:

the planarizing fluid comprises a liquid solution, a plurality of spherical resistance elements composed of latex, and a plurality of abrasive particles composed of at least one of silicon oxide particles, aluminum oxide particles, cerium oxide particles, a titanium oxide and tantalum oxide particles.

12. In a planarizing process of a microelectronic substrate against a planarizing medium having abrasive particles, a method of endpointing the planarizing process, comprising:

pressing a plurality of resistance elements between the substrate and the planarizing medium as at least one of the substrate or the planarizing medium moves relative to the other, the resistance elements being separate from the abrasive particles of the planarizing medium, and the resistance elements causing a change in drag force between the substrate and the planarizing medium when the substrate becomes at least substantially planar such that the drag force changes at a first rate when the substrate is not substantially planar and at a second rate greater than the first rate when the substrate is at least substantially planar; and stopping removal of material from the substrate when the drag force between the substrate and the planarizing surface changes at the second rate.

13. The method of claim 12 wherein stopping the removal of material from the substrate comprises:

measuring a change in drag force between the substrate and the polishing pad with a current meter coupled to a drive motor for a platen that supports the polishing pad, the current meter detecting a change in amperage through the drive motor; and terminating removal of material from the substrate when the current meter detects a change in amperage through the drive motor corresponding to the second rate of change of the drag force.

14. The method of claim 13 wherein terminating removal of material comprises ceasing planarization of the substrate when the amperage through the drive motor changes by approximately 25%–100% of an initial amperage through the drive motor when the substrate has a highly topographical surface.

15. The method of claim 12 wherein stopping the removal of material from the substrate comprises:

measuring a change in drag force between the substrate and the polishing pad with a current meter coupled to a secondary drive motor of a substrate holder that carries the substrate, the current meter detecting a chance in amperage through the secondary drive motor; and terminating removal of material from the substrate when the current meter detects a change in amperage through the secondary drive motor corresponding to the second rate of change of the drag force.

16. The method of claim 15 wherein terminating removal of material comprises ceasing planarization of the substrate when the amperage through the secondary drive motor increases by approximately 25%–100% of an initial amperage through the drive motor when the substrate has a highly topographical surface.

17. The method of claim 12 wherein stopping the removal of material from the substrate comprises:

measuring a change in drag force between the substrate and the polishing pad by measuring a temperature of a component of the planarizing process; and terminating removal of material from the substrate when the temperature changes corresponding to the second rate of change of the drag force.

18. The method of claim 17 wherein measuring a temperature of a component comprises sensing the temperature of the planarizing fluid flowing off of the polishing pad with a temperature probe.

19. The method of claim 17 wherein measuring a temperature of a component comprises sensing the temperature of the planarizing fluid on the polishing pad with an infrared sensor.

20. The method of claim 12, further comprising depositing a planarizing fluid onto the polishing pad, the planarizing fluid having a liquid solution and a plurality of spherical resistance elements composed of latex.

21. The method of claim 12, further comprising depositing a planarizing fluid onto the polishing pad, the planarizing fluid including a liquid solution, a plurality of spherical resistance elements composed of latex, and a plurality of abrasive particles composed of at least one of a silicon oxide, an aluminum oxide, a cerium oxide, a titanium oxide or a tantalum oxide.

22. In a planarizing processes of a microelectronic substrate on a polishing pad, a method of endpointing the planarizing process, comprising:

pressing the substrate against the polishing pad in the presence of a planarizing fluid on the polishing pad, the planarizing fluid including a liquid solution and a plurality of viscosity altering elements that are separate from a plurality of abrasive particles in one of the planarizing fluid or the polishing pad, the viscosity altering elements being colloidal with the liquid solution;

changing the viscosity of the planarizing fluid between the substrate and the polishing pad as the substrate becomes at least substantially planar, the viscosity altering elements causing a change in the viscosity of the planarizing fluid that changes a drag force between the substrate and planarizing medium defined by the planarizing fluid and the polishing pad; and stopping removal of material from the substrate when the drag force between the substrate and the planarizing medium changes.

23. The method of claim 22 wherein the viscosity altering elements comprise resistance elements that cause an increase in the viscosity of the planarizing fluid, and wherein:

changing the viscosity of the planarizing fluid comprises increasing the viscosity of the planarizing fluid as the substrate becomes at least substantially planar to cause an increase in the drag force between the substrate and the planarizing medium; and stopping removal of material comprises terminating removal when the drag force increases rapidly.

24. The method of claim 23, further comprising adding spherical latex resistance elements to the liquid solution to produce the planarizing fluid.

25. The method of claim 24, further comprising mixing abrasive particles with the liquid solution and the resistance elements.

26. The method of claim 22 wherein the viscosity altering elements comprise thinning elements that cause a decrease in the viscosity of the planarizing fluid, and wherein:

changing the viscosity of the planarizing fluid comprises decreasing the viscosity of the planarizing fluid as the substrate becomes at least substantially planar to cause a decrease in the drag force between the substrate and the planarizing medium; and stopping removal of material comprises terminating removal when the drag force decreases.

27. The method of claim 26, further comprising adding star polymer thinning elements to the liquid solution to produce the planarizing fluid.

28. In an abrasive planarizing processes of a microelectronic substrate on a polishing pad, a method of endpointing the planarizing process, comprising:

pressing the substrate against the polishing pad in the presence of a planarizing fluid on the polishing pad, the planarizing fluid including a liquid solution and a plurality of friction elements separate from a plurality of abrasive particles in one of the planarizing fluid or the polishing pad, the friction elements causing a rapid increase in friction between the substrate and the planarizing medium as the substrate becomes substantially planar; and stopping removal of material from the substrate when the rate of change of friction between the substrate and a planarizing medium defined by the planarizing fluid and the polishing pad rapidly increases.

29. The method of claim 28, further comprising adding spherical latex resistance elements to the liquid solution to produce the planarizing fluid.

30. The method of claim 29, further comprising mixing abrasive particles with the liquid solution and the resistance elements.

31. A method of planarizing a microelectronic substrate, comprising:

depositing a planarizing fluid onto a polishing pad, the planarizing fluid having a plurality of friction elements that cause a change in drag force between the substrate and the polishing pad as the substrate becomes at least substantially planar, and at least one of the planarizing fluid and the polishing pad having a plurality of abrasive particles;

moving at least one of the substrate and the polishing pad with respect to the other to impart relative motion between the substrate and the polishing pad, the relative motion removing material from a front surface of the substrate, and the relative motion causing a first rate of change of drag force between the substrate and the polishing pad when the front surface of the substrate is not at least substantially planar; and stopping removal of material from the front surface of the substrate when the rate of change of the drag force between the substrate and the polishing increases to a second rate greater than the first rate.

32. The method of claim 31 wherein stopping the removal of material from the substrate comprises:

measuring a change in drag force between the substrate and the polishing pad with a current meter coupled to a drive motor for a platen that supports the polishing pad, the current meter detecting a change in amperage through the drive motor; and terminating removal of material from the substrate when the current meter detects a significant change in amperage through the drive motor.

33. The method of claim 32 wherein terminating removal of material comprises ceasing planarization of the substrate when the amperage through the drive motor changes by approximately 25%–100% of an initial amperage through the drive motor when the substrate has a highly topographical surface.

34. The method of claim 31 wherein stopping the removal of material from the substrate comprises:

measuring a change in drag force between the substrate and the polishing pad with a current meter coupled to a secondary drive motor of a substrate holder that carries the substrate, the current meter detecting a change in amperage through the secondary drive motor; and terminating removal of material from the substrate when the current meter detects a significant change in amperage through the secondary drive motor.

35. The method of claim 34 wherein terminating removal of material comprises ceasing planarization of the substrate when the amperage through the secondary drive motor changes by approximately 25%–100% of an initial amperage through the drive motor when the substrate has a highly topographical surface.

36. The method of claim 31 wherein stopping the removal of material from the substrate comprises:

measuring a change in drag force between the substrate and the polishing pad by measuring a temperature of a component of the planarizing process; and terminating removal of material from the substrate when the temperature changes significantly.

37. The method of claim 36 wherein measuring a temperature of a component comprises sensing the temperature of the planarizing fluid flowing off of the polishing pad with a temperature probe.

38. The method of claim 36 wherein measuring a temperature of a component comprises sensing the temperature of the planarizing fluid on the polishing pad with an infrared sensor.

39. The method of claim 31 wherein depositing a planarizing fluid onto the polishing pad comprises dispensing a planarizing fluid including a liquid solution, a plurality of friction elements having particle sizes of 2–100 nm, and a plurality of abrasive particles having particle sizes of 12–200 nm.

40. The method of claim 39, further comprising:

providing latex spheres for the resistance particles; and using abrasive particles from a group consisting of aluminum oxide, silicon dioxide, cerium oxide, titanium oxide and tantalum oxide.

41. A method of planarizing a microelectronic substrate comprising:

moving at least one of the substrate and a polishing pad with respect to the other to impart relative motion between the substrate and the polishing pad in the presence of a planarizing fluid, the polishing pad and the planarizing fluid removing material from a front surface of the substrate;

increasing the viscosity of the planarizing fluid between the substrate and the polishing pad, the planarizing fluid having a first viscosity when the front face of the substrate is not substantially planar and a second viscosity greater than the first viscosity as the substrate becomes at least substantially planar; and stopping removal of material from the front surface of the substrate when the drag force between the substrate and a planarizing medium defined by the planarizing fluid and the polishing pad increases corresponding to a change in viscosity of the planarizing fluid from the first viscosity to the second viscosity.

42. The method of claim 41 wherein increasing the viscosity of the planarizing fluid comprises adding resistance elements to the planarizing fluid, the resistance elements being separate from a plurality of abrasive particles in the planarizing medium, and the resistance elements causing a rapid increase in friction between the substrate and the planarizing medium as the substrate becomes substantially planar.

43. The method of claim 42 wherein:

the planarizing fluid comprises a liquid solution, a plurality of spherical resistance elements composed of latex, and a plurality of abrasive particles; and the method further comprises depositing the planarizing solution onto the polishing pad.

44. The method of claim 42 wherein:

the planarizing fluid comprises a liquid solution, a plurality of spherical resistance elements composed of latex, and a plurality of abrasive particles composed of oxide particles.

45. A planarizing fluid for planarizing a microelectronic substrate, comprising:

a liquid solution; and a plurality of friction elements in the liquid solution separate from any abrasive particles in the planarizing medium, the friction elements having a particle size and being composed of a material to increase the viscosity of the planarizing fluid between the substrate and a polishing pad from a first viscosity when the substrate is not substantially planar and a second viscosity when the substrate is at least substantially planar.

46. The planarizing fluid of claim 45 wherein the friction elements have particle sizes of 2–100 nm.

47. The planarizing fluid of claim 46 wherein the friction elements comprise latex particles.

48. The planarizing fluid of claim 47 wherein the latex particles are spherical.

49. The planarizing fluid of claim 46, further comprising abrasive particles in the liquid solution.

50. The planarizing fluid of claim 49 wherein the abrasive particles comprise abrasive particles having particle sizes greater than 50 nm.

51. The planarizing fluid of claim 49 wherein the abrasive particles comprise aluminum oxide particles.

52. The planarizing fluid of claim 49 wherein the abrasive particles comprise silicon dioxide particles.

53. The planarizing fluid of claim 49 wherein the abrasive particles comprise cerium oxide particles.

54. The planarizing fluid of claim 49 wherein the abrasive particles comprise titanium oxide particles.

55. The planarizing fluid of claim 45 wherein:

the friction elements are 2%–10% by weight of the planarizing fluid; and the liquid solution is 60%–98% by weight of the planarizing solution.

56. The planarizing fluid of claim 55 wherein the friction elements comprise latex particles having particle sizes of 2–20 nm.

57. The planarizing fluid of claim 56, further comprising abrasive particles having particle sizes greater than 50 nm, the abrasive particles being selected from a group consisting of aluminum oxide, silicon dioxide, cerium oxide, titanium oxide and tantalum oxide.

58. The planarizing fluid of claim 57 wherein the liquid solution comprises an ammonia based solution.

59. The planarizing fluid of claim 57 wherein the liquid solution comprises a potassium based solution.

60. The planarizing fluid of claim 45 wherein the resistance elements are composed of non-abrasive particles.

61. A planarizing fluid for planarizing a microelectronic substrate, comprising:

a liquid solution; and a plurality of friction element elements in the solution, the friction elements being composed of a material that causes a rapid increase in friction between the substrate and a planarizing medium as the substrate becomes substantially planar; and a plurality of abrasive particles in the liquid solution, the abrasive particles being composed of material that abrades material from a surface of the substrate during planarizing of the substrate.

62. The planarizing fluid of claim 61 wherein the friction elements have particle sizes of 5–10 nm.

63. The planarizing fluid of claim 62, further comprising abrasive particles having particle sizes greater than 50 nm.

64. The planarizing fluid of claim 63 wherein the friction elements comprise latex particles.

65. The planarizing fluid of claim 64 wherein the abrasive particles having particle sizes greater than 50 nm, the abrasive particles being selected from a group consisting of aluminum oxide, silicon dioxide, cerium oxide, titanium oxide and tantalum oxide.

66. A planarizing machine for removing material from a microelectronic substrate, comprising:

a table;

a polishing pad attached to the table;

a planarizing fluid deposited onto the polishing pad, at least one of the polishing pad and the planarizing fluid having a plurality of abrasive particles, and the planarizing fluid also having a plurality of resistance elements, the resistance elements causing an increase in the viscosity of the planarizing fluid from a first viscosity when the substrate is not substantially to a second viscosity as the substrate becomes at least substantially planar;

a carrier assembly including a substrate holder to hold the substrate, the carrier assembly moves the substrate holder to press the substrate against the planarizing fluid and the polishing pad, and at least one of the substrate holder and the table being moveable in a plane to translate the polishing pad with respect to the substrate; and a friction sensor to measure an increase in friction between the substrate and polishing pad.

67. The planarizing machine of claim 66 wherein the resistance elements have particle sizes of 2–100 nm.

68. The planarizing machine of claim 66 wherein the planarizing fluid further comprises abrasive particles and the resistance elements are non-abrasive particles.

69. The planarizing machine of claim 66 wherein the resistance elements comprise latex particles.

70. The planarizing machine of claim 66 wherein the abrasive particles have particle sizes greater than 50 nm, the abrasive particles being selected from a group consisting of aluminum oxide, silicon dioxide, cerium oxide, titanium oxide and tantalum oxide.

71. The planarizing machine of claim 66 wherein:

the friction elements are 2%–10% by weight of the planarizing fluid; and the liquid solution is 60%–98% by weight of the planarizing solution.

* * * * *

UNITED STATES PATENT AND TRADEMARK OFFICE

CERTIFICATE OF CORRECTION

PATENT NO. : 6,046,111
DATED : April 4, 2000
INVENTOR(S) : Karl M. Robinson

It is certified that error appears in the above-identified patent and that said Letters Patent is hereby corrected as shown below:

Column 12,
Line 52, reads "polishing increases" should read -- polishing pad increases --

Column 15,
Line 6, reads "friction element elements" should read -- friction elements --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*